US012752180B2

(12) United States Patent
Steiner

(10) Patent No.: US 12,752,180 B2
(45) Date of Patent: Oct. 6, 2026

(54) CARD SHUFFLER

(71) Applicant: DCMX SAS, Paris (FR)

(72) Inventor: Francois Steiner, London (GB)

(73) Assignee: B3 Metrix Ltd, London (GB)

( * ) Notice: Subject to any disclaimer, the term of this patent is extended or adjusted under 35 U.S.C. 154(b) by 151 days.

(21) Appl. No.: 18/856,448

(22) PCT Filed: Apr. 27, 2023

(86) PCT No.: PCT/GB2023/051118
§ 371 (c)(1),
(2) Date: Oct. 11, 2024

(87) PCT Pub. No.: WO2023/209380
PCT Pub. Date: Nov. 2, 2023

(65) Prior Publication Data

US 2025/0186871 A1 Jun. 12, 2025

(30) Foreign Application Priority Data

Apr. 28, 2022 (GB) ..... 2206199

(51) Int. Cl.
*A63F 1/12* (2006.01)

(52) U.S. Cl.
CPC ..... *A63F 1/12* (2013.01)

(58) Field of Classification Search
None
See application file for complete search history.

(56) References Cited

U.S. PATENT DOCUMENTS

| | | | | |
|---|---|---|---|---|
| 8,931,779 | B2 * | 1/2015 | Grauzer | A63F 1/12 273/149 P |
| 9,266,011 | B2 * | 2/2016 | Johnson | A63F 1/06 |
| 9,345,952 | B2 * | 5/2016 | Blaha | A63F 1/12 |
| 9,566,501 | B2 * | 2/2017 | Stasson | A63F 1/12 |
| 9,616,324 | B2 * | 4/2017 | Krenn | A63F 1/14 |
| 2007/0273099 | A1 * | 11/2007 | Fleckenstein | A63F 1/14 273/309 |
| 2014/0103607 | A1 * | 4/2014 | Blaha | A63F 1/12 273/149 R |
| 2017/0301188 | A1 * | 10/2017 | Pececnik | A63F 1/12 |
| 2025/0186871 | A1 * | 6/2025 | Steiner | A63F 1/12 |

* cited by examiner

*Primary Examiner* — Julie K Brocketti
(74) *Attorney, Agent, or Firm* — Weiss and Moy P.C.; Jeffrey D. Moy

(57) ABSTRACT

A card shuffler comprises a card loader, a card storage area, and a card collector. The card storage area comprises a carousel rotatable about an axis. The carousel has a plurality of slots defined by dividing walls wherein at least some of the dividing walls when considered from a side elevation, lie on lines which tangentially meet a circle centred on the axis of the carousel.

11 Claims, 8 Drawing Sheets

CARD SHUFFLER

The present specification relates to a card shuffler, that is, a machine for randomising cards, usually a deck of playing cards.

Card shufflers are machines that can automatically shuffle or randomise the order of a number of cards. One known type of shuffler comprises a card storage area known as a carousel, which includes compartments defined by dividing walls radiating from a central point. Cards are inserted into the compartments and retained by springs, and later released and ejected from the compartment, the carousel rotating between insertions and ejections so that the order of the ejected cards is randomised. The mechanism is complex, costly and subject to failure.

The object of the present invention is to reduce or eliminate this problem. Another independent object of the present invention is to improve how the cards are handled after leaving the carousel.

According to the present invention, there is provided a card shuffler according to claim 1.

Figure 1:
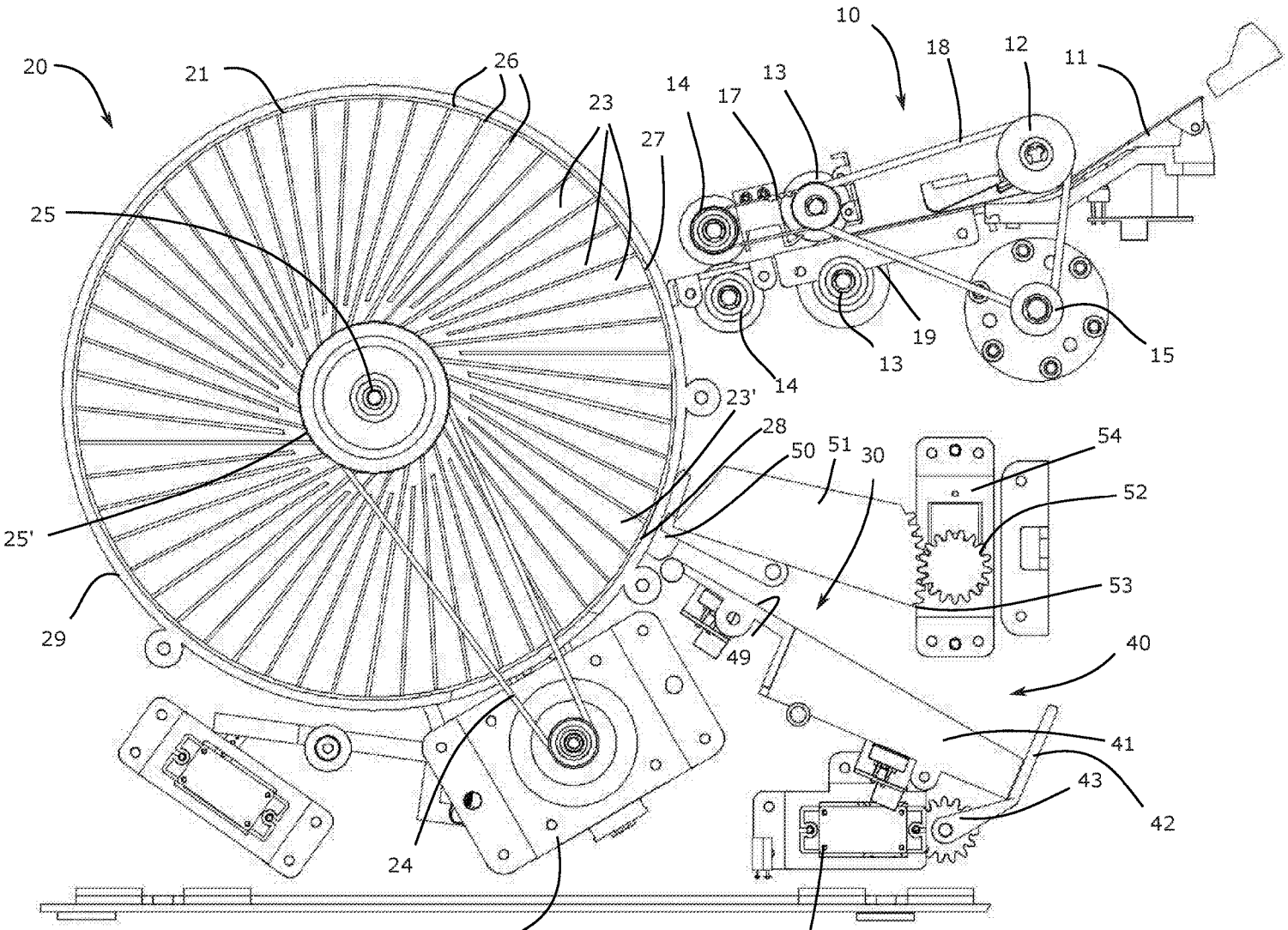
Figure 2:
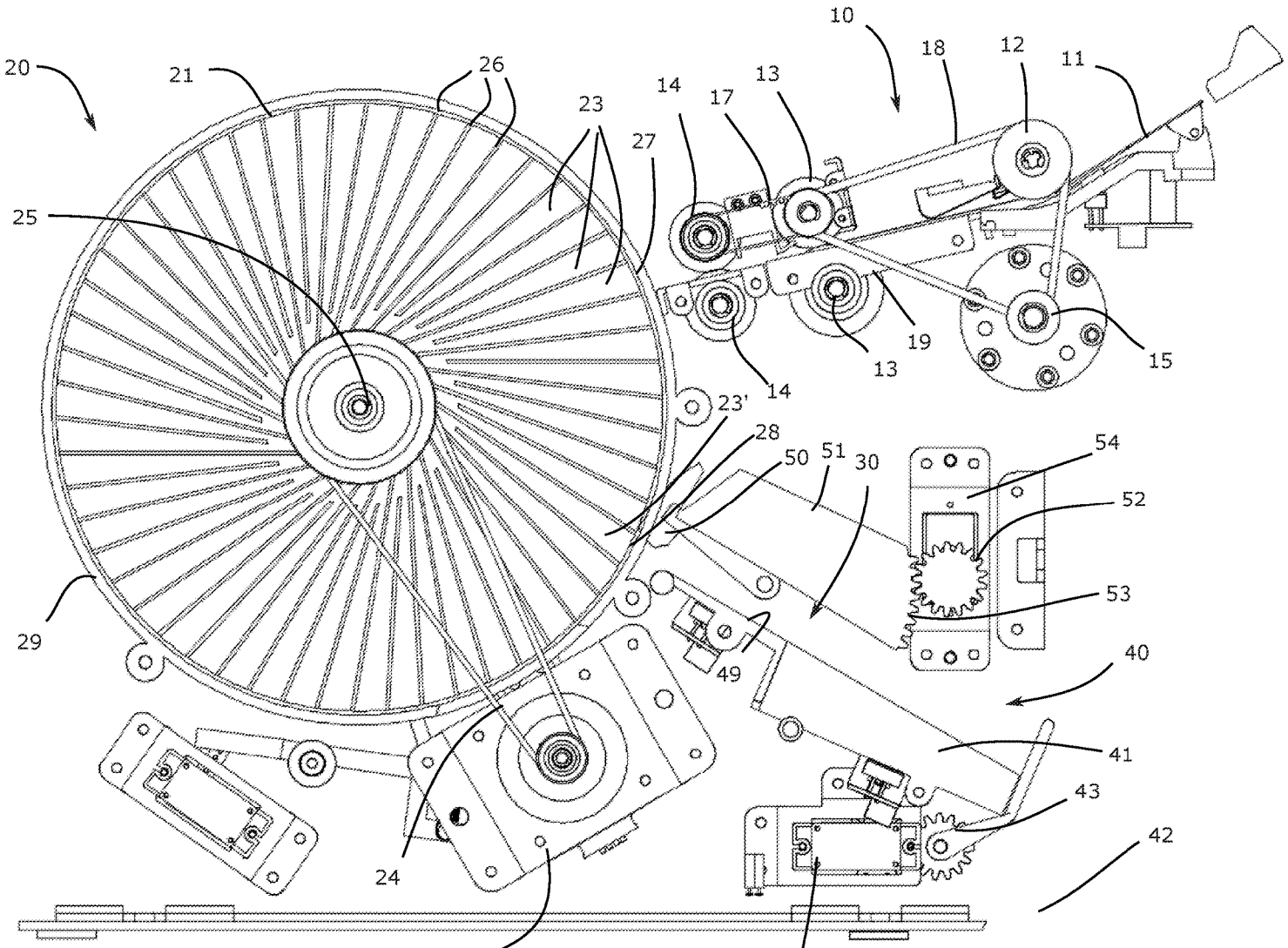
Figure 3:
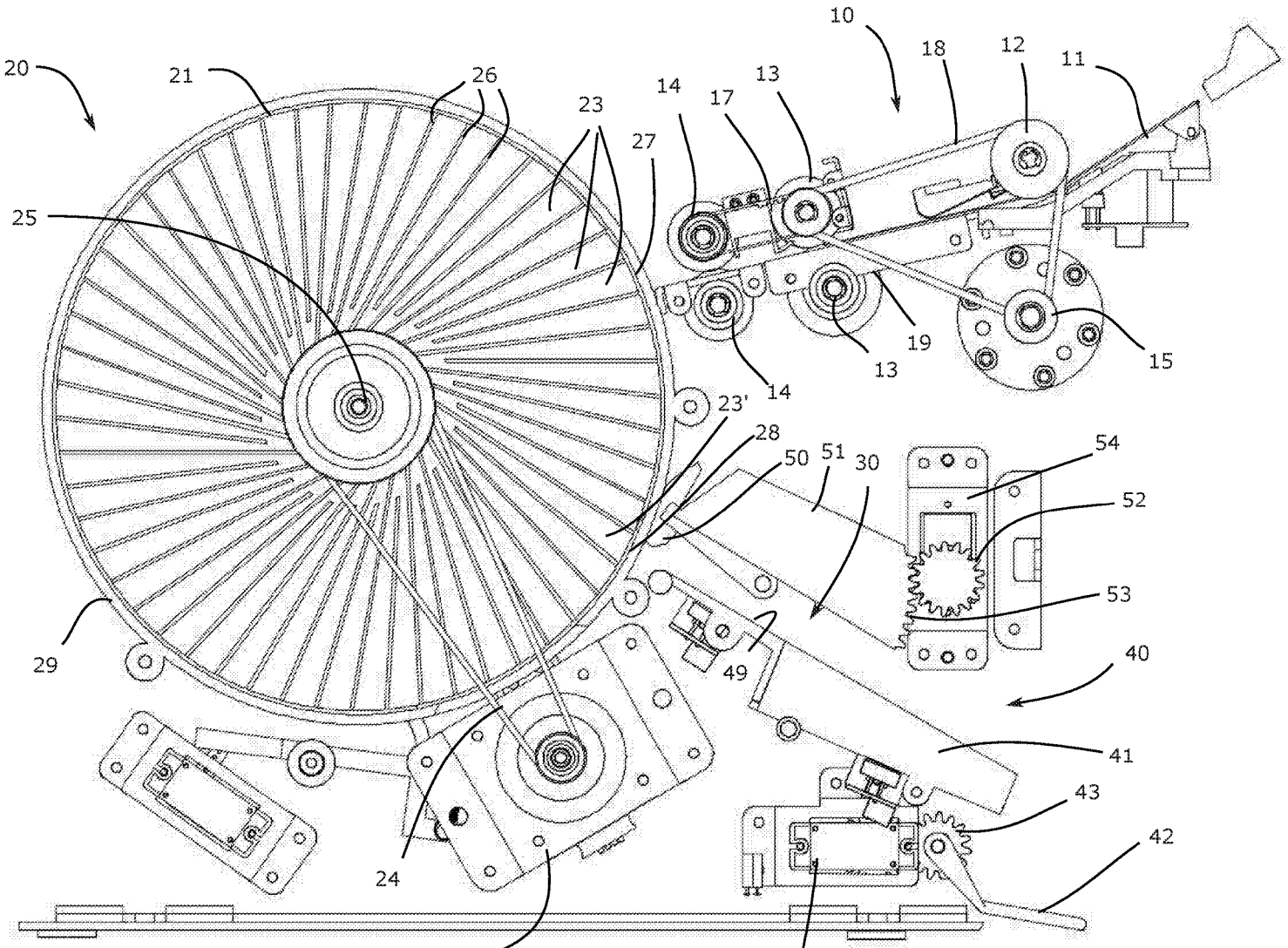
Figure 4A:
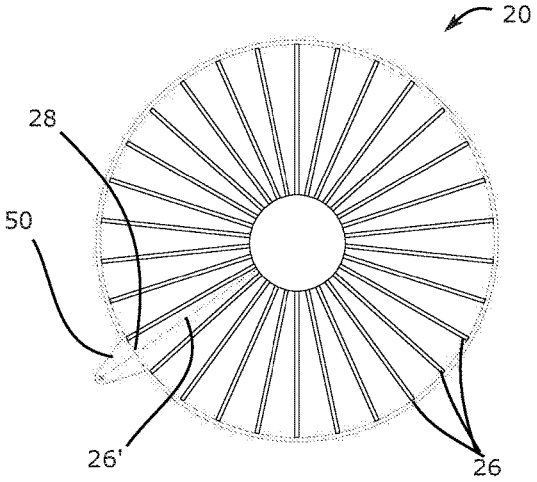
Figure 4B:
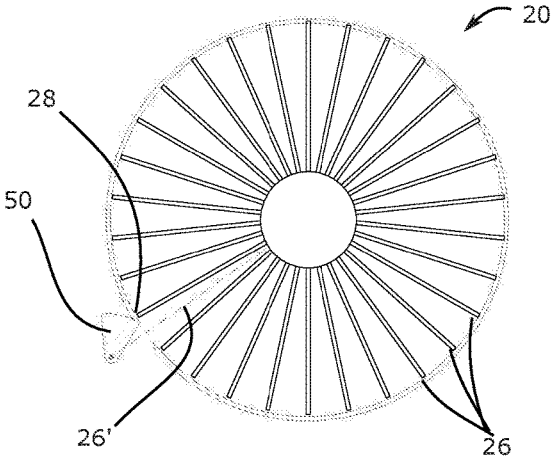
Figure 5A:
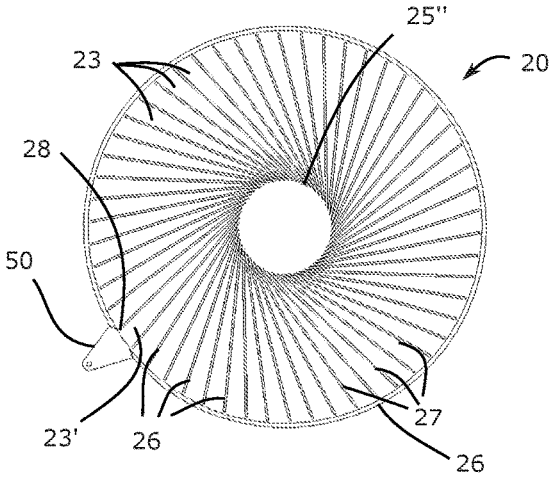
Figure 5B:
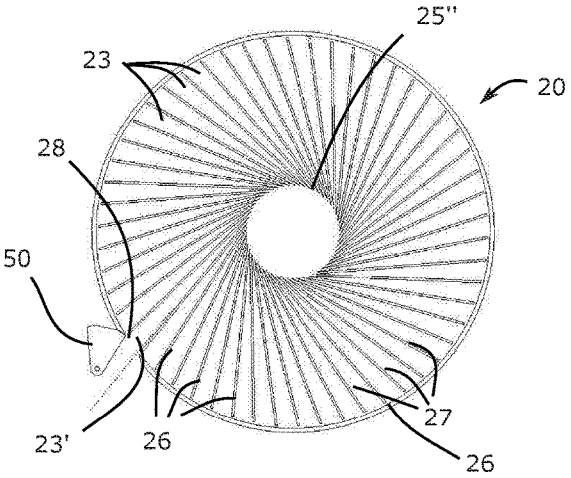

The invention will now be described, by way of example, with reference to the drawings, of which FIG. 1 is a side elevation of an embodiment of the card shuffler FIG. 2 is a side elevation of the card shuffler of FIG. 1 at another stage of operation FIG. 3 is a side elevation of the card shuffler of FIG. 1 at a further stage of operation FIGS. 4*a* and 4*b* are diagrammatic side elevations of the carousel of a known card shuffler FIGS. 5*a* and 5*b* are diagrammatic side elevations of the carousel of the card shuffler of FIG. 1

Figure 6A:
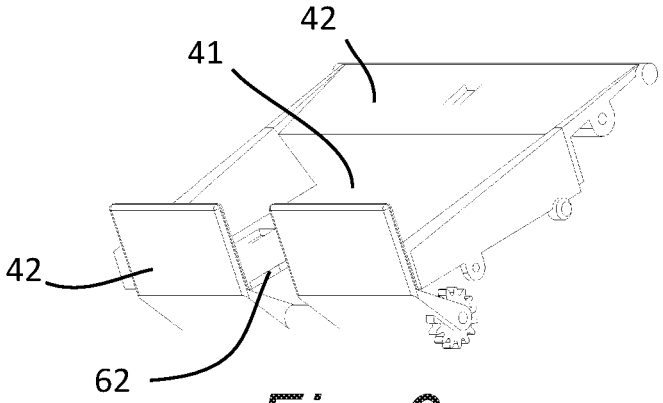
Figure 6B:
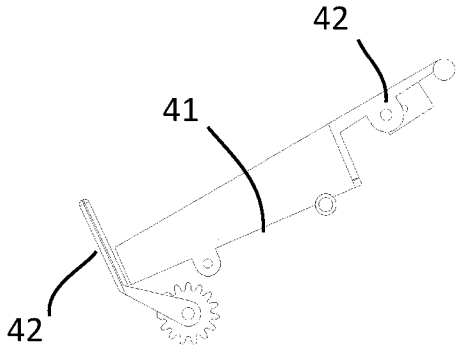

FIGS. 6*a* and 6*b* are a perspective view and side elevation of the exit slide assembly of the card shuffler of FIG. 1 in a first position.

Figure 6C:
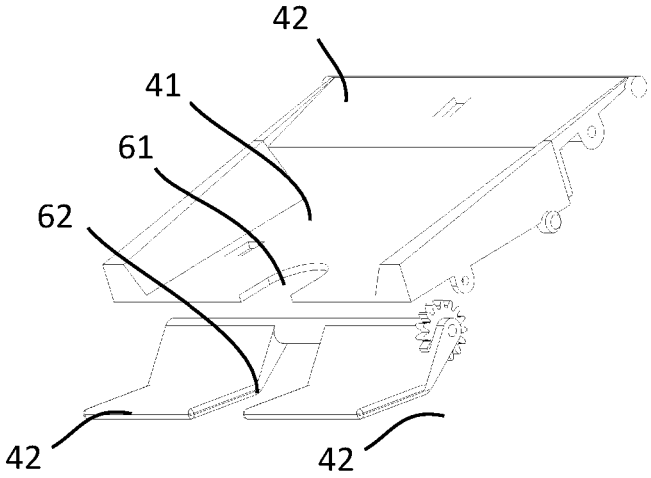
Figure 6D:
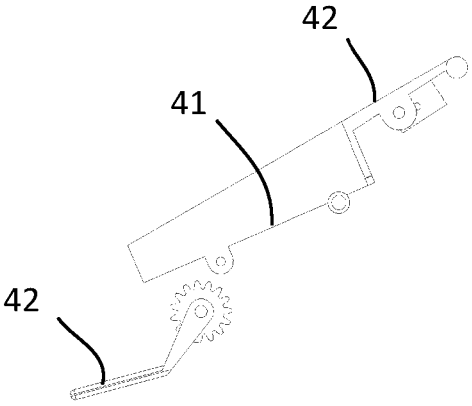

FIGS. 6*c* and 6*d* are a perspective view and side elevation of the exit slide assembly of the card shuffler of FIG. 1 in a second position.

Figure 7:
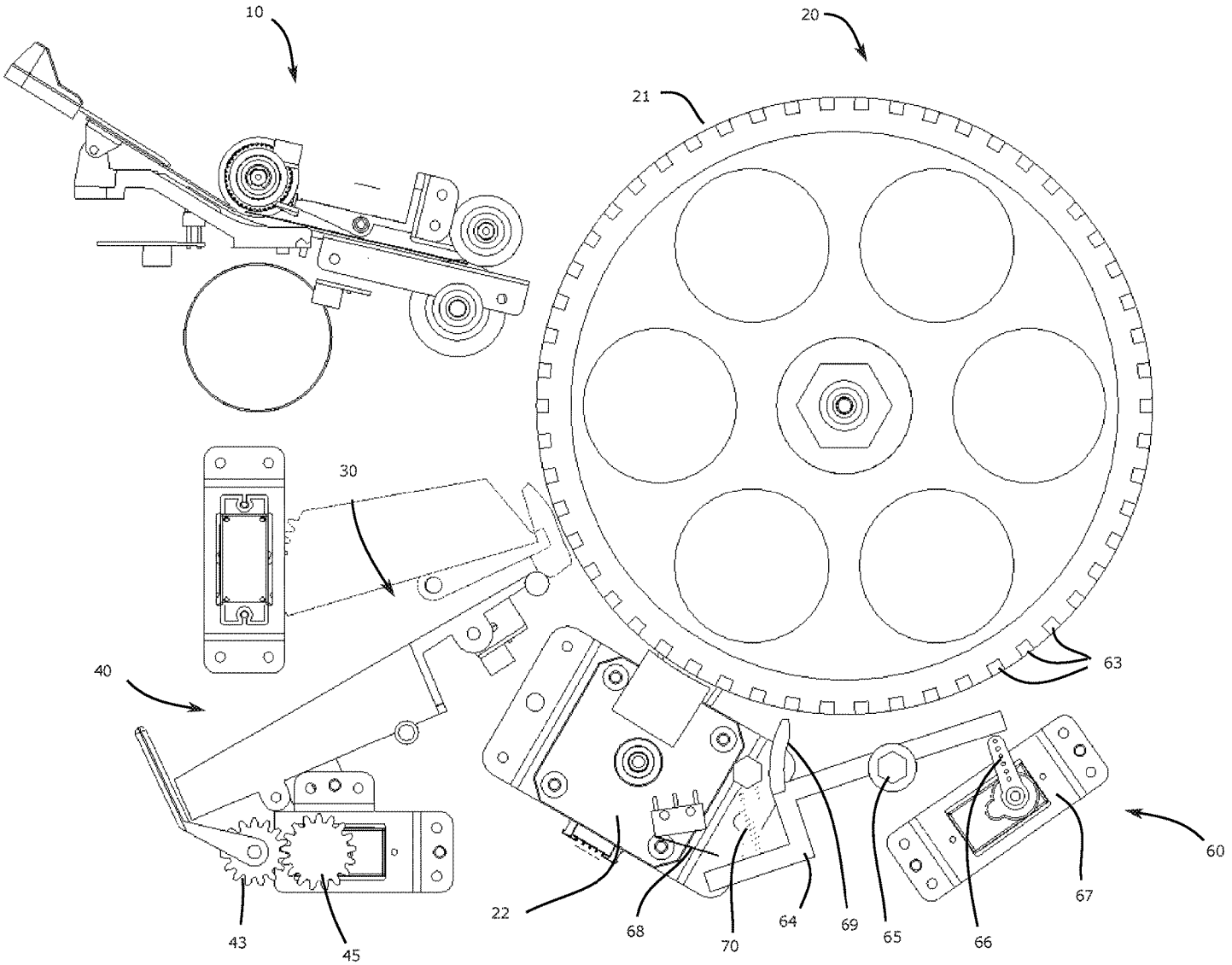
Figure 8:
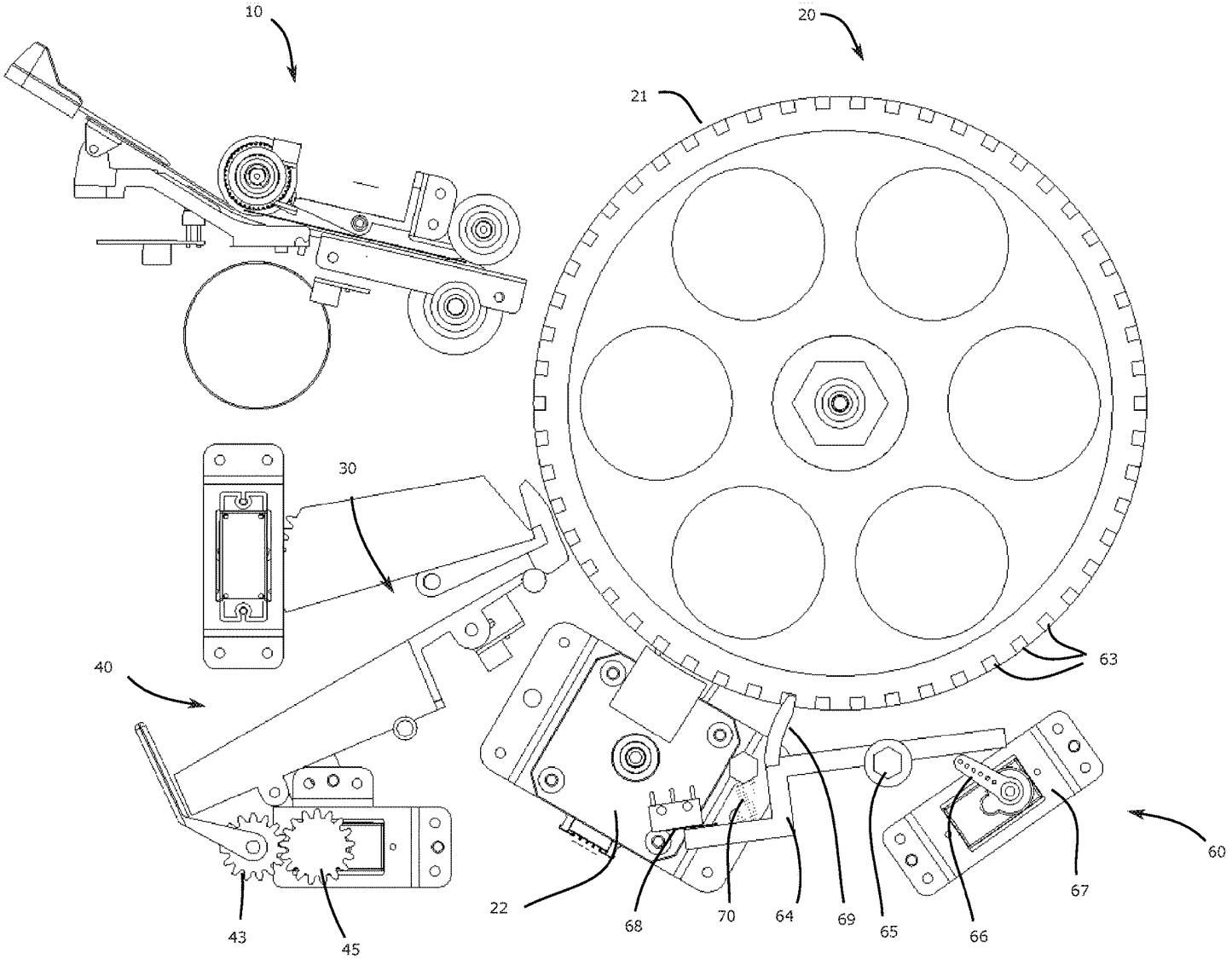
Figure 9:
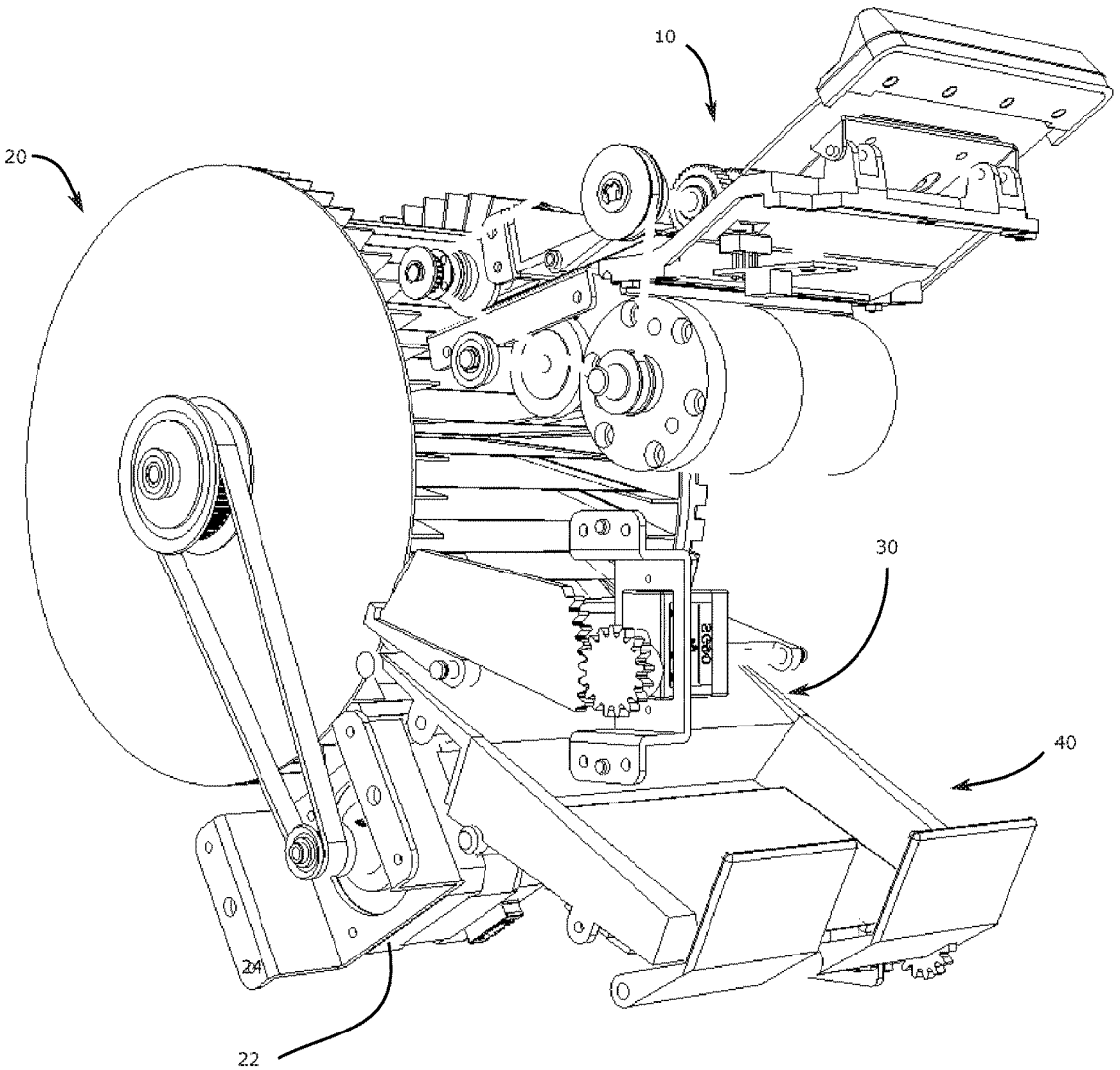

FIG. 7 is a side elevation of the opposite side of the card shuffler of FIG. 1 at another stage of operation FIG. 8 is a side elevation of the opposite side of the card shuffler of FIG. 1 at a further stage of operation; and FIG. 9 is a perspective view of the card shuffler of FIG. 1.

Referring to FIGS. 1 and 9, the card shuffler comprises a card loader 10, a card storage area 20, an exit slide assembly 30, and a card collector 40. Both the card loader 10 and exit slide assembly 30 are located on the same side of the card storage area 20.

The card loader 10 comprises a card loading tray 11, a crenelated take-off roller 12 which advances the uppermost card onto a feeder slide 19, where it is advanced along the feeder slide 19 by smooth roller pairs 13 and 14 into the card storage area 20. The cards could also be urged against the crenelated take-off roller 12 by a spring or other resilient biasing means. The take-off roller 12 and upper roller of the roller pair 13 are rotated by an endless belt 18 driven by a motor and motor shaft 15, while the upper roller of roller pair 14 is driven by an endless belt 17 coupled to the upper roller of the roller pair 13. The smooth roller pair 13 may be geared to rotate at a faster speed than the take-off roller 12, so that card is advanced at a faster speed by the roller pair 13 once it has been grabbed from the take-off roller 12. The roller pair 14 is geared to rotate at the same or a faster speed than the roller pair 13. The roller pair 14 is optional, and each roller pair may be alternatively implemented using just a single roller. Other known card loaders may be substituted. At least one optical sensor is included along the path of the playing card being loaded, controlling the operation of the rollers.

The deck of cards loaded onto the card loader tray 11 are set perpendicular to the direction of travel and in contact with the crenelated roller. The rotation of said roller will turn and align cards in turn for loading into the machine. This system is simple, fast, and robust and can be implemented with one electric motor for all rollers. It also works with cards of different widths (bridge or poker-size) and materials (paper of various thickness, plastic), accommodating most if not all brands of playing cards.

The card storage area 20 consists of a rotating carousel 21 actioned by an electric motor 22 via an endless belt 24 coupled to the carousel axle 25 (possibly via an axle hub 25') comprising several individual card compartments or 'slots' 23 preferably distributed around the radius of the carousel 21 and preferably each of equal size (i.e. each of the slots 23 subtends an equal angle).

As previously described, the carousel 21 comprises a plurality of slots 23 distributed generally radially around carousel axis 25. The slots 23 are defined by dividing walls 26, so that each slot has an upper and lower dividing wall 26 each of which is shared by the two neighbouring slots. A fixed cylindrical shell 29 surrounds the circumference of the carousel, and constrains each card within its slot. The shell 29 is fixed relative to the rotatable carousel 21 and the slots 23, and the shell is provided with an inlet opening 27 and outlet opening 28.

The inlet opening 27 is aligned with the slide 19, so that cards picked up and advanced by the card loader 10 can be inserted into a slot that has been rotated to align with the slide 19 and inlet opening 27. Similarly, the outlet opening 28 is aligned with the exit slide assembly, so that a cards to be dispensed by a particular slot can be aligned with the outlet opening 28 by the rotation of the carousel for dispensation.

When a slot 23 that is to accept a card from the card loader 10 is aligned with the inlet opening 27 and slide 19, it will be seen that the lower dividing wall of the slot is angled upwards, the end of the slot closest to the carousel axle being lower than the end of the slot adjacent to the inlet opening 27. Gravity will therefore ensure that the card slides into the slot 23 and the card remains in the carousel, until the carousel is rotated and the card is kept retained in the carousel by the shell 29.

When a slot 23' that is to dispense a card from to the exit slide assembly 30 is aligned with the outlet opening 28 and the exit slide assembly 30, it will be seen that the lower dividing wall of the slot is angled downwards, the end of the slot closest to the carousel axle being higher than the end of the slot adjacent to the outlet opening 28. Gravity will therefore cause the card to slide out of the slot and into the exit slide assembly 30. In order to only allow cards that have been selected to be dispensed to exit the carousel 21, a pivoting latch 50 reciprocates under the control of an arm 51 with has a toothed sector which engages with a toother pinion 52, so that the appropriate rotation of the pinion raises or lowers the latch; in FIG. 1, the latch is shown as closed over the outlet opening 28, prevent a card from leaving the slot; referring to FIG. 2, the toother pinion 52 has been rotated to cause the latch to lift and uncover the outlet opening 28, allowing any card in the slot 23' to slide out of the slot onto the exit slide assembly 30. After the card has been allowed to slide out of the slot 23', the latch operation can is reversed to cover the outlet opening 28.

The dividing walls slots 26 are offset from a strictly radial configuration. Known card storage carousels are divided into slots or compartments by dividing walls which emanate radially, the dividing walls lying on lines which intersect at the centre of the circle of the carousel, which is also where the axle and axis of rotation is located. Referring to FIGS. 4*a* and 4*b*, we first consider the difficulties that would be encountered if one were to attempt to rely on a simple latch to allow a card to be dispensed using gravity. A latch 50 is moveable between two positions, a lowered position shown in FIG. 4*a* where the outlet opening 28 covered and any card in the adjacent slot is constrained in the slot, and a raised position shown in FIG. 4*b* where the outlet opening 28 is uncovered and any card in the adjacent slot is allowed to slide out of the slot. The exit latch rotates on an axis located in a plane that encompasses the carousel's axis of rotation and substantially bisects the exit window, this position being necessary to ensure full uncovering of the aperture of the outlet opening and smooth closure of said opening. It will be seen that in the case of radial compartments, the latch would interfere with the ejection path of the cards. Further, although the slope of the lower dividing wall which coincides with line 26' is angled downwards (i.e. the edge of dividing wall distal to the centre of the carousel is lower than the proximal edge), the slope may not be enough to permit the card to slide out of the slot under gravity alone, and the card fails to leave the slot as it adheres to the dividing wall, principally held by friction between the surface of the card and the dividing wall.

To address this problem, referring to FIGS. 5*a* and 5*b*, the dividing walls 26, 27 of slots 23 are arranged so that rather than each dividing wall 26, 27 coinciding with lines which emanate from the centre of the circle of the carousel, they instead lie on lines which are tangential to the circumference of an inner circle 25". This angular offset spaces the axis of rotation of the latch 50 from the ejection path of the card and increases the angle of the lower dividing wall of a slot 23' aligned with the latch and outer opening 28, thus improving the release of the card onto the exit slide assembly 30. The angular offset also increases the length of the dividing walls and therefore the capacity of each slot. Since the angle between adjacent dividing walls is reduced, it may be beneficial that some dividing walls 27 do not extend to the inner circle 25" but instead stop short, so that the full length dividing walls 26 and the shortened dividing walls 27 alternate around the carousel.

This allows the latch to be pivoted in a simple manner without the open latch interfering with a card exiting the outlet opening 28 under gravity, and obviates arranging the latch with a compound pivot, stub axles etc to try and alter the effective pivot axis of the latch, leading to a simple and compact latch design.

The inner circle 25" may coincide with the actual hub of the carousel, however the inner circle 25" may be a geometric construct which does not coincide with the actual hub, with the proximal edge of the dividing walls 26 abutting the actual hub of the carousel which may have a larger or smaller diameter than the inner circle 25"; furthermore or all the dividing walls could be shortener in the manner of the shortened dividing walls 27.

Referring back to FIGS. 1 to 3, the exit slide assembly 30 includes a slide surface 49, and a collecting area 41 extending from and located below the slide surface 49, such that the cards that have exited slots 23 through the outlet opening 28 slide along the slide surface 49 and drop into the collecting area 41. Referring particular to FIGS. 1 and 2, cards that have exited though the outlet opening 28 may be held in the collecting area 41 by a gate 42, which includes a cranked arm that rotates with a toothed cog 43 driven by a motor 44 and toothed pinion 45 (visible in FIGS. 7 and 8).

Referring to FIG. 2, when it is desired to collect the cards in the collecting area 41, for example when a complete hand has been dealt, it is possible to pick the cards from the collecting area 41 even when the gate 42 is closed. Referring to FIGS. 6*a* to 6*d*, the collecting area 41 and the gate 42 may feature cut out regions 61, 62 respectively to aid in a user picking up the dealt cards. At least one sensor detects the presence of cards in the collecting area which may trigger the dealing of the next hand for example.

Alternatively, dealt cards can be released as follows: once a hand or other number of cards are dealt, motor 44 rotates the toothed pinion 43 and consequently the gate 42 pivots downwards to release the cards in the collecting area 41 for use in a game. After the cards have been picked up by the user (for example a player or a dealer), the operation is reversed, the motor 44 rotating the toothed pinion 43 to pivot the gate 42 upwards to constrain any further cards that exit into the exit slide assembly 30 until they too are ready to be collected by a user or released on the table again.

Generally, after a particular number of cards (e.g. a single hand) have been released from the collecting area by the gate 42 on to the table surface, the gate may be raised and the dispensing of the next hand into the collecting area can commence immediately.

Alternatively, the gate 42 can be retained in a lowered position (as shown in FIG. 3) to allow one or more cards to exit the carousel 21 from the slots 23' through the outlet opening 28 to slide down the exit slide assembly 30 directly on to a table surface, for example when a community card is dealt in a game.

Referring to FIG. 7, the card shuffler may include an indexing means 60 which monitors and adjusts the angular position of the carousel 21. The indexing means 60 comprises a cranked arm 64 is rotatable about a pivot 65, a lever 66 drivable by a motor 67, and a contact switch 68. A first half of the arm 64 features a claw 69 which may be pressed against the outer circumference of the carousel 21. The circumference of the carousel 21 features notches 63 which can receive the claw when the notch Is correctly aligned, the notches 63 being equal in number to and angularly distributed to correspond to the slots 23. The cranked arm 64 is biased such that the first half of the arm is urged towards the carousel by a spring 70 (though of course the arm could be biased by other means, such as a spring or resilient means under compression acting against the arm at another point). Acting against this biasing by the spring 70, the lever 66 can be rotated by motor 67 to bear on a second half of the arm 64 to move or constrain the first half of the arm 64 so that it is spaced from the carousel and the claw 69 does cannot engage with the carousel (as shown in FIG. 7). In this position, the terminal end of the first half of the cranked arm 64 is spaced from the contact switch 68. The arm is constrained in this position whenever the carousel is rotated as described above.

Referring now to FIG. 8, when the carousel has ceased rotation in order to accept a card being loaded, or dispense a card to be dealt, the lever 66 is rotated away from the second half of the arm 64 by motor 67, so that the claw 69 is urged against the circumference of the carousel by the spring 70. As previously described, the circumference of the carousel features notches 63 which are equal in number to and angularly distributed to correspond to the slots 23. When the carousel is rotated so that the slots 23 properly align with the inlet opening 27 and outlet opening 28, the claw 69 aligns with a notch 63, and the terminal end of the first half of arm 64 triggers the contact switch 68, which signals to the microprocessor that the carousel is properly aligned.

If however the carousel 21 has not been rotated precisely, which can occur for example if the angular position of the carousel stepper motor 22 drifts, the claw 69 will bear against a radially raised portion of the circumference of the carousel, these raised portions extending between each notch 63, and the terminal end of the first half of arm 64 will not depress the contact switch 68. This will indicate to the microprocessor that the carousel is not precisely aligned, and an adjustment process can be initiated. To adjust the position of the carousel, the carousel motor 22 is rotated by a small increments in the previous direction of angular travel until the claw 69 locates in the appropriate notch 63 and the terminal end of the first half of arm 64 correctly depresses the contact switch 68, indicated that the correct alignment of the carousel has been achieved.

The claw 69 also serves to lock the position of the carousel between rotations, so that the carousel motor (which is typically a stepper motor) does not have to be continuously energised.

The arm 64 is shown here as cranked, as this conveniently fits the geometry of the other components, it will though be realised that a straight arm or some other shaped arm or lever could be employed with the appropriate modifications.

The indexing arm is here shown as essentially mechanical with a claw engaging with circumferential notches in the carousel, however the angular position and indexing of the carousel may alternatively be carried out by other means, such as an optical sensor, or capacitive sensing, in which case some alternative angular locking means such as a ratchet mechanism may be provided to lock the carousel when the carousel motor is not energised.

The motors used to control the card loader 10, the rotation of the carousel 21, the latch of the exit slide assembly 30, the gate of the card collector 40, and the indexing means are all ideally stepper motors or servo motors whose angular position can be accurately controlled, however other motors could be used with the appropriate modification The motor for the card loader in general will not require such accuracy and may be any suitable motor. Endless drive belts are extensively used in the embodiments described, however gears or other equivalent drive and linkage means could equally be used with the appropriate modifications. Similarly, the toother pinions or cogs shown in the described embodiments could be implemented using alternative equivalent linkages or belts.

A microprocessor (not here shown) controls 1) the rotation of the carousel 2) the loading of one card at a time from the loading tray into storage 3) the ejection of one card at a time from storage to the exit slide and 4) the configuration of the card collector. The microprocessor keeps track of the status (empty/full) of each slot, of the position of the carousel and the configuration of the card collector. This information is stored in permanent memory and preserved even in the case of a power loss. The microprocessor includes a random or pseudo-random number generation process to achieve the random shuffling of the cards between insertion and ejection of the cards in the slots. A practical way of achieving satisfactory random number generation without resorting to dedicated hardware random number generators is described here: https://b3metrix.com/randomisation/f/effective-randomisation-using-a-standard-microprocessor In case the motor used to rotate the carousel does not provide an absolute reference for position (as is the case for stepper motors), a "homing" mechanism would be provided to insure consistency between the physical position of the carousel and the value stored in the index register in the microprocessor memory. A way to achieve this could be to incorporate a sensor (using for instance Hall effect or infrared light detection) in the fixed shell 29 and a device (magnet or reflector) near the circumference of the mobile carousel that would trigger said sensor when their positions coincide. At power up, the microprocessor would instruct the carousel to be rotated until the homing sensor is triggered. The carousel would then be maintained in position and the index register would be reinitialised accordingly in the microprocessor memory.

The basic sequence of operation is as follows:

Loading

A deck of cards is set into the loading tray by the human operator, at least one sensor detects the presence of cards in said loading tray. The carousel is rotated so that an empty slot faces the loading tray. The top card in the loading tray is pulled by rollers into said empty slot. At least one sensor follows the position of the card being loaded. This process is repeated until either a) the loading tray is empty, or b) the carousel is full.

Dealing a Single Card:

The card shuffler randomly selects one full slot, aligns it to the exit slide, opens the exit latch, then closes it once the card has exited. Again, at least one sensor follows the position of the card being released.

Dealing hands of N cards to P players—two options are possible, that can be either selected/preselected by the operator or defined automatically using criteria such as the nature of the game being played, the number of players P or the number N of cards being dealt to each player:

a) either dealing N×P cards one by one in turn, i.e., repeat the previous process of dealing one card N×P times, which is typically suitable for hands comprising a small number of cards b) or dealing P hands of N cards one hand at a time i.e., first randomly identify N full slots, then sequentially extract the cards they contain in the order of the slots, this full sequence being performed P times in total. This process requires (at most) P rotations of the carousel, which would save time for games such as Bridge, where all cards are dealt Dealing N Community Cards This follows the same procedure as b) above for P=1

Advanced Operation:

Beyond the basic operation described above, the card shuffler can be programmed to randomise and deal cards for specified single-deck games: for instance, if the "Bridge" program is selected by the operator, once a 52-card deck is loaded into the loading tray, the card shuffler automatically deals in sequence 4 random hands of 13 cards, thus emptying the carousel. For other games, the number of players would have to be specified by the operator.

The card collector can be configured to either retain cards or let them pass through. This can be realised by moving its end side from the path of the exiting cards, thus allowing them to slide freely on the gaming table. The configuration can be either selected by the operator or defined automatically using criteria such as the game being played, the number of players, and the number of cards being dealt.

It should be noted that for games which do not use the full deck, it suffices to reload the cards previously dealt for the card shuffler to be immediately ready for the next round, a much faster process than manually shuffling and dealing.

Description of the Card Shuffler Mobile Phone App

Stand-Alone Mode

The card shuffler can be operated in stand-alone mode, from a dashboard located on the machine. The dashboard may comprise buttons, switches, rotary switches, screen, touch screen. Some buttons can be placed based on ergonomic considerations (a "load" button near the card loading tray for instance)

Functions available on the machine are basic functions, namely:

- Load cards
- Randomise a full deck into the exit compartment
- Prepare a number N of randomised cards into the exit compartment
- Deal a hand of N randomised cards directly on the gaming surface
- Deal N randomised card one by one on the gaming surface
- Empty the machine And the access to some settings and utilities (language, software version).

Additionally or alternatively, particular games may be pre-loaded and pre-programmed, so that the user can select from such options from a simple menu.

This mode is well suited when the machine is to be used as a simple deck shuffler, or for games such as Bridge, when hands are dealt at the beginning of the round, with no other shuffling or dealing further required.

Remote-Controlled Mode

In this mode, the machine is remotely controlled by a device such as a mobile phone or tablet via radio frequencies such as Wi-Fi or Bluetooth. On the machine, as seen before, the microprocessor takes care of the lower-level operations (operation of sensors, motors, and actuators, tracking of compartment status, randomisation, and basic functions described above: loading, dealing N cards, emptying). The mobile app takes advantage of the advanced technology available on a mobile phone or tablet to provide the operator with a rich user interface, guiding him step by step to the progress of a game, in a way specific to the game being played and the number of players. Basic operations are accurately performed in the right sequence, in a way that is transparent for the operator.

Alongside the pre-programmed games are available on the app, and there is the possibility for the operator to define custom games in the app through parameters such as:

- Minimum and maximum number of players (example for Texas Hold'em: 2 to 10)
- Number of cards per player (Hold'em: 2) with possible exceptions (for instance player #1 receives one card less than the others)
- Existence of community cards, number, sequence, and name (Hold'em: 3 "Flop", 1 "Turn", 1 "River".)
- Possibility to pick additional cards during the game and how many at a time (Hold'em: no, Crazy Eights: 1 or 2 at a time)
- Possibility to reload cards during the round (Hold'em: no, Crazy Eights: yes)

As any mobile app, this app can be updated over time to add new games or new features, without altering the basic functions living on the machine microprocessor.

Below example of remote-controlled operation for a game of Texas Hold'em and a game of Bridge:

Example 1: A Game of Texas Hold'Em with 6 Players Requires the Operator to Load Cards and to Press a (Virtual) Button 5 Times as the Game Progresses 1. "Texas Hold'em" is selected in the app.
2. If there are less than 52 cards in the machine, the app prompts the operator to load cards until this number is reached.
3. The app prompts the operator for the number of players.
4. The operator selects the number and confirms (or just confirms if the number is unchanged since last round)<Press #1>
5. The app prompts to start dealing hands, the operator confirms <Press #2>
6. The machine deals the players' hands, in this case 12=6×2 cards (one by one on the table for instance)
7. The app prompts to deal the "Flop" (or alternatively end round), when the betting round is finished the operator confirms <Press #3>
8. The machine deals the "Flop" (3 cards)
9. The app prompts to deal the "Turn" (or alternatively end round), when the betting round is finished the operator confirms <Press #4>
10. The machine deals the "Turn" (1 card)
11. The app prompts to deal the "River" (or alternatively end round), when the betting round is finished the operator confirms <Press #5>
12. The machine deals the "River" (1 card)
13. The round has ended, there are less than 52 cards in the machine, the app prompts the operator to load cards until this number is reached (back to step 2)

Example 2: A Game of Bridge Requires the Operator to Load Cards and to Press a (Virtual) Button Once at Most 1. "Bridge" is selected in the app.
2. If there are less than 52 cards in the machine, the app prompts the operator to load cards until this number is reached.
3. When the count of cards in the carousel reaches 52, the app optionally prompts to start dealing hands, with the operator confirming by a button press <Press #1>. Alternatively, the app skips directly to step 4.
4. The first randomised hand of 13 cards is prepared in the exit tray.
5. When picked up by a player, the next hand of 13 cards is prepared and so forth for hands #3 and #4.

Several independently implementable concepts are disclosed herein, in particular:

(i) offsetting slots from a radial arrangement
(ii) providing a moveable collecting gate
(iii) apparatus to detect slots and their alignment
(iv) providing a latch which constrains or allows a card to drop under gravity from a slot Each of these concepts can beneficially on its own without implementing the other concepts, though they are particularly suited to being implemented in a single apparatus.

Of points (ii) to (iv) above, the following configurations are noteworthy for advantageous implementation:

A1. A card shuffler comprising
a card loader,
a card storage area, having an opening where cards are ejected and
and a card collector having a card collecting area
the card collector including a gate having a first position where cards are constrained in the card collecting area, and a second position where cards slide from the card collecting area onto a table or other dealing surface.

A2. A card shuffler according to configuration A1 wherein the card collector is located below the card storage area opening.

A3. A card shuffler according to configuration A2 wherein the card collector includes a slide surface located substantially level with the card storage area opening and above the card collecting area.

A4. A card shuffler according any of configuration A1 to A3 wherein the card collector includes a gate comprising a cranked arm that rotates with a toothed pinion or pulley driven by a motor.

A5. A card shuffler comprising a card loader, a card storage area, and and a card collector the card storage area comprises a carousel rotatable about an axis, the carousel having a plurality of slots defined by dividing walls and indexing mechanism including detectable regions on the carousel corresponding to each slot, and a sensor for ascertaining whether or not a detectable region, and therefore the slot, is correctly aligned.

A6. A card shuffler according to configuration A5 wherein the detectable regions comprise a plurality of notches on the outer circumference of the carousel, and the sensor including a claw that is engageable with each notch when correctly aligned.

A7. A card shuffler according to configuration A6 wherein the claw is born on a pivoting arm that abuts a contact switch when the claw engages a notch.

A8. A card shuffler according to any of configurations A5 to A7 wherein when it is ascertained that a detectable region is not correctly aligned, further rotation of the carousel is actuated.

A9. A card shuffler comprising a card loader, a card storage area, and and a card collector the card storage area comprises a carousel rotatable about an axis, the carousel having a plurality of slots defined by dividing walls a latch the latch being pivotable about a pivot point to prevent or selectively allow cards to exit the carousel through an outlet opening under the action of gravity.

A10. A card shuffler according to configuration A9 wherein at least some of the dividing walls when considered from a side elevation, lie on lines which tangentially meet a circle centred on the axis of the carousel.

A11. A card shuffler according to configuration A9 or A10 wherein the carousel includes a hub having a radius centred on the axis of the carousel, and at least some of the dividing walls meet the hub.

A12. A card shuffler according to any of configurations A9 to A11 wherein alternating dividing walls are of different lengths.

A13. A card shuffler according to any of configurations A9 to A12 wherein a latch is included which is pivotable about a pivot point to prevent or selectively allow cards to exit the carousel through an outlet opening, wherein the pivot point substantially coincides with a radial line drawn from the axis about which the carousel rotates and bisecting the outlet opening.

It should also be stressed that other infeed mechanisms may be substituted for the specific mechanism shown here.

In this specification an apparatus/method/product "comprising" certain features is intended to be interpreted as meaning that it includes those features, but that it does not exclude the presence of other features.

Many variations are possible without departing from the scope of the present invention as defined in the appended claims.

The invention claimed is:

1. A card shuffler comprising a card loader, a card storage area, and a card collector, the card storage area comprises a carousel rotatable about an axis, the carousel having a plurality of slots defined by dividing walls wherein at least some of the dividing walls when considered from a side elevation, lie on lines which tangentially meet a circle centered on the axis of the carousel, a latch is included which is pivotable about a pivot point to prevent or selectively allow cards to exit the carousel through an outlet opening under the action of gravity, wherein the pivot point substantially coincides with a radial line drawn from the axis about which the carousel rotates and bisecting the outlet opening, the tangential configuration of the dividing walls being such as to enable the rotating latch to operate without obstructing the ejection path of cards from the carousel.

2. A card shuffler according to claim 1 wherein the carousel includes a hub having a radius centred on the axis of the carousel, and at least some of the dividing walls meet the hub.

3. A card shuffler according to claim 1 wherein alternating dividing walls are of different lengths.

4. A card shuffler according to claim 1 wherein the card storage area, having an opening where cards are ejected and the card collector having a card collecting area the card collector including a gate having a first position where cards are constrained in the card collecting area, and a second position where cards slide from the card collecting area onto a table or other dealing surface.

5. A card shuffler according to claim 4 wherein the card collector is located below the card storage area opening.

6. A card shuffler according to claim 5 wherein the card collector includes a slide surface located substantially level with the card storage area opening and above the card collecting area.

7. A card shuffler according to claim 4 wherein the card collector includes a gate comprising a cranked arm that rotates with a toothed pinion or pulley driven by a motor.

8. A card shuffler according to claim 1 wherein the card storage area includes an indexing mechanism including detectable regions on the carousel corresponding to each slot, and a sensor for ascertaining whether or not a detectable region, and therefore the slot, is correctly aligned.

9. A card shuffler according to claim 8 wherein the detectable regions comprise a plurality of notches on the outer circumference of the carousel, and the sensor including a claw that is engageable with each notch when correctly aligned.

10. A card shuffler according to claim 9 wherein the claw is born on a pivoting arm that abuts a contact switch when the claw engages a notch.

11. A card shuffler according to claim 8 wherein when it is ascertained that a detectable region is not correctly aligned, further rotation of the carousel is actuated.

* * * * *